US005988916A

United States Patent [19]

Liu

[11] Patent Number: 5,988,916

[45] Date of Patent: Nov. 23, 1999

[54] ROTARY TYPE AUTOMATIC PENCIL

[76] Inventor: Tsang-Jenn Liu, No. 11, Lane 61, Fu Le Street, Hsinchuang City, Taipei Hsien, Taiwan

[21] Appl. No.: 09/132,239

[22] Filed: Aug. 11, 1998

[51] Int. Cl.[6] ..... B43K 21/08; B43K 21/10

[52] U.S. Cl. ..... 401/63; 401/77

[58] Field of Search ..... 401/63, 64, 77

[56] References Cited

U.S. PATENT DOCUMENTS

| | | | |
|---|---|---|---|
| 1,328,300 | 1/1920 | Saunders | 401/77 |
| 1,411,116 | 3/1922 | Mason, Jr. | 401/77 |
| 1,463,803 | 8/1923 | De Witt | 401/77 |
| 1,539,468 | 5/1925 | Cook et al. | 401/77 |
| 1,568,951 | 1/1926 | Ballou | 401/64 |
| 1,734,784 | 11/1929 | Vierling et al. | 401/77 |
| 1,849,210 | 3/1932 | Welsh | 401/64 |
| 1,912,674 | 6/1933 | Wehn | 401/77 |
| 2,110,551 | 3/1938 | Freidlein et al. | 401/63 |
| 2,492,234 | 12/1949 | Melchiorre | 401/64 |
| 3,477,791 | 11/1969 | Yamashita | 401/64 |

FOREIGN PATENT DOCUMENTS

| | | | |
|---|---|---|---|
| 331271 | 6/1930 | United Kingdom | 401/77 |

*Primary Examiner*—Charles R. Eloshway
*Attorney, Agent, or Firm*—Rosenberg, Klein & Bilker

[57] ABSTRACT

A rotary type automatic pencil includes a front socket member fastened to a sleeve at the bottom to hold a guide tube, a rotary member mounted within the front socket member around the guide tube, a helical spring mounted around the guide tube and fastened to the rotary member, a lead holder tube and a propelling element mounted inside the guide tube, wherein rotating the rotary member causes the helical spring to force the lead holder tube and the propelling element upwards/downwards along a longitudinal sliding slot of the guide tube; the propelling element is lowered to push the lead out of the lead holder tube when the lead holder tube is stopped in a lower limit position and the rotary member is continuously rotated.

4 Claims, 9 Drawing Sheets

ROTARY TYPE AUTOMATIC PENCIL

BACKGROUND OF THE INVENTION

The present invention relates to automatic pencils, and more particularly to a rotary type automatic pencil.

A variety of automatic pencils have been disclosed, and have appeared on the market. These automatic pencils include two types, one controlled by a push button, and the other controlled by a rotary cap. U.S. Pat. No. 1,546,490 discloses a rotary type automatic pencil which uses a helical spring to guide the movement of the lead. However, this structure cannot let the lead be fully utilized, and the lead tends to be forced back to the inside of the barrel by an error.

SUMMARY OF THE INVENTION

The present invention has been accomplished to provide a rotary type automatic pencil which eliminates the aforesaid drawbacks. According to one aspect of the present invention, the rotary type automatic pencil comprises a front socket member, a guide tube having a longitudinal sliding slot and a bottom end fastened to the front socket member, a rotary member mounted within the front socket member and rotated around the guide tube, a helical spring mounted around the guide tube and fastened to the rotary member, a lead holder tube mounted inside the guide tube and moved along the longitudinal sliding slot of the guide tube and holding a lead for writing, the lead holder tube having a longitudinal sliding slot at the periphery and a projecting rod raised from the peripheral, the projecting rod of the lead holder tube being inserted through the longitudinal sliding slot of the guide tube and coupled to the helical spring, and a propelling element inserted into said lead holder tube at a top side and stopped and stopped against the lead held in said lead holder tube, the propelling element having a projecting rod perpendicularly raised from a top end thereof and inserted through the longitudinal sliding slot of the lead holder tube and the longitudinal sliding slot of the guide tube and coupled to the helical spring, wherein rotating the rotary member causes the helical spring to force the lead holder tube and the propelling element upwards/downwards along the longitudinal sliding slot of the guide tube. The propelling element is lowered to push the lead out of the lead holder tube when the lead holder tube is stopped in a lower limit position and the rotary member is continuously rotated. According to another aspect of the present invention, different lead adapters may be alternatively used and attached to the lead holder tube to hold any of a variety of leads of different diameters.

DETAILED DESCRIPTION OF THE PREFERRED EMBODIMENTS

Figure 1:
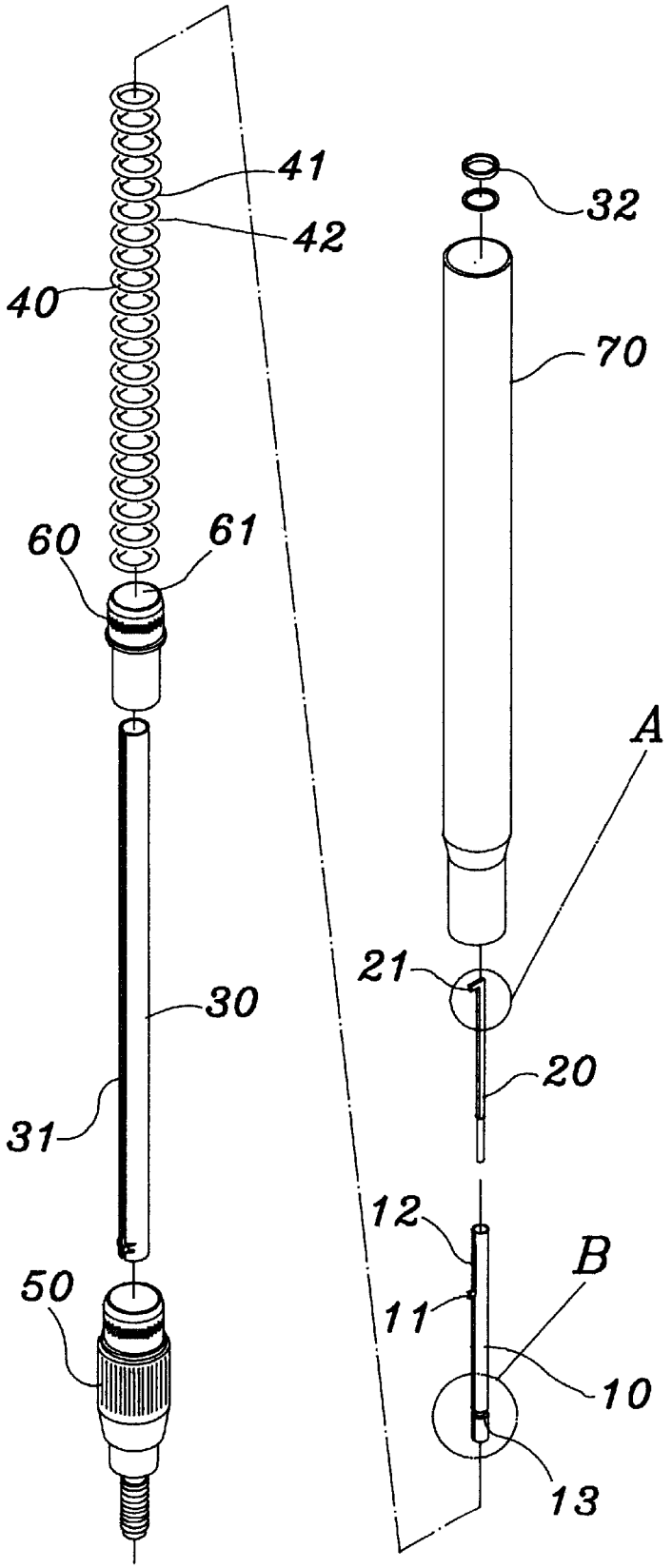
FIG. 1; is an exploded view of a rotary type automatic pencil according to the present invention.
Figure 1A:
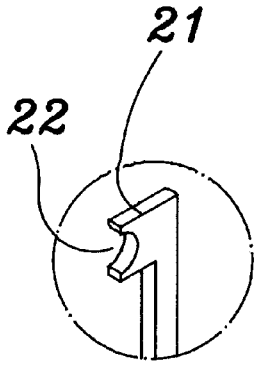
FIG. 1A is an enlarged view of part A of FIG. 1.
Figure 1B:
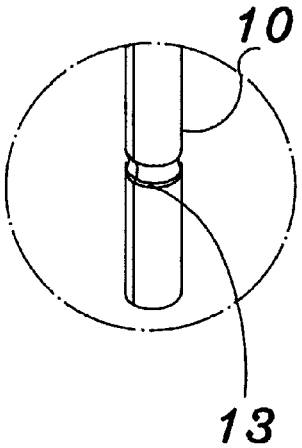
FIG. 1B is an enlarged view of part B of FIG. 1.
Figure 2:
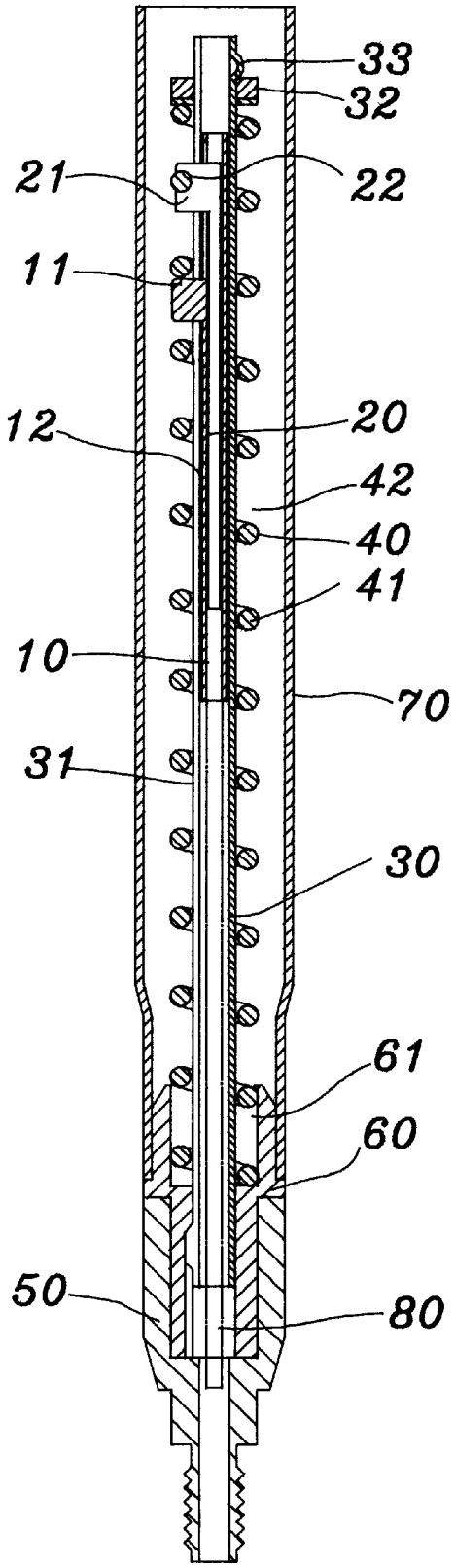
FIG. 2 is a sectional plain view of the rotary type automatic pencil according to the present invention.

Referring to FIGS. 1, 1A, 1B and 2, a rotary type automatic pencil in accordance with the present invention is shown comprised of a lead holder tube 10, an elongated propelling element 20, a guide tube 30, a helical spring 40, a front socket member 50, a rotary nmember 60, and a sleeve 70.

The guide tube 30 has a longitudinal sliding slot 31 at the periphery extended between top and bottom end thereof.

The lead holder tube 10 holds a lead 80 inside the guide tube 30, having a longitudinal sliding slot 12 at the periphery, and a projecting rod 11 raised from the periphery below the longitudinal sliding slot 12 and moved with the lead holder tube 10 in the guide tube 30 along the longitudinal sliding slot 31.

The propelling element 20 is inserted into the top end of the lead holder tube 10 and stopped against the lead in the lead holder tube 10, having a projecting rod 21 perpendicularly raised from the top end thereof. The projecting rod 21 has a U-notch 22 at the end (see FIG. 1A).

The front socket member 50 is fastened to one end namely the bottom end of the sleeve 70.

The rotary member 60 is revolvably supported inside the front socket member 50 and fixedly fastened to the bottom end of the sleeve 70, having a top hole 61.

The helical spring 40 is sleeved onto the guide tube 30, having a bottom end of the helical spring 40 fastened to the top hole 61 of the rotary member 60 and a top end stopped at a stop element 32, which is fastened to the top end of the guide tube 30 by a locating member 33.

When assembled, the projecting rod 11 of the lead holder tube 10 is inserted through the longitudinal sliding slot 31 of the guide tube 30 and engaged into the spiral way 42 defined by the wire body 41 of the helical spring 40, the projecting rod 21 of the propelling element 20 is inserted through the longitudinal sliding slot 31 of the guide tube 30 with the U-notch 22 engaged with the wire body 41 of the helical spring 40.

Figure 3:
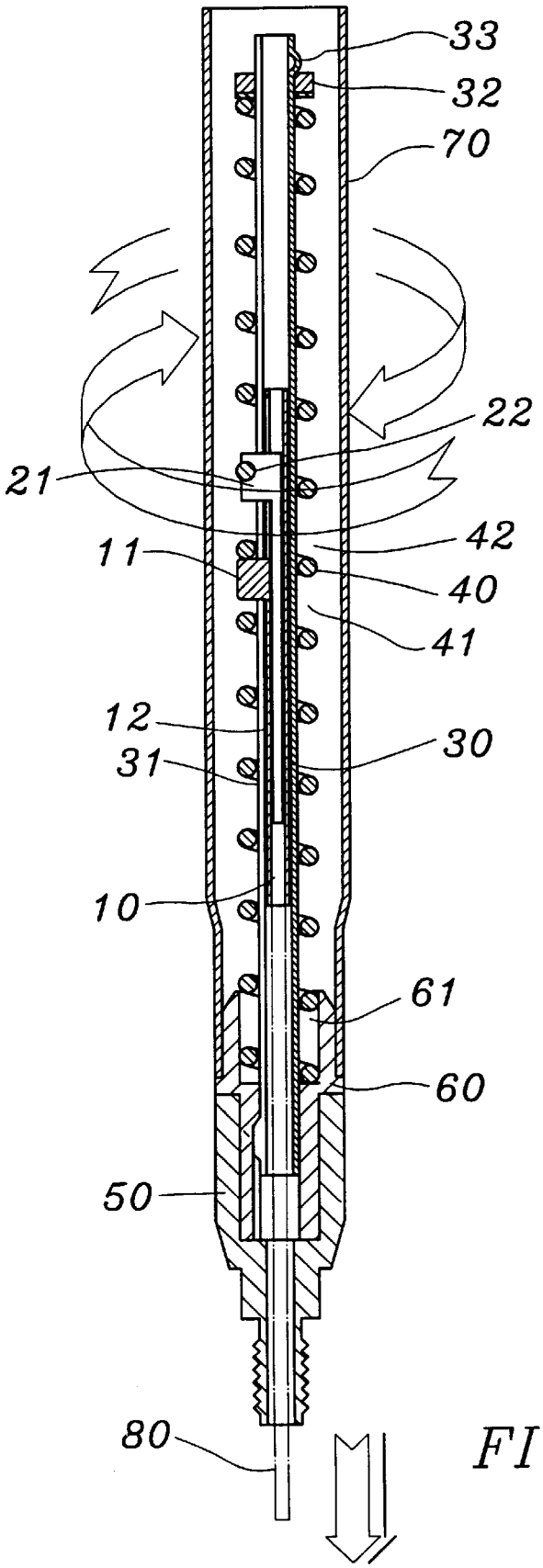
FIG. 3 is similar to FIG. 2 but showing the sleeve rotated, the lead extended out of the front socket member.

Referring to FIG. 3, when the sleeve 70 is rotated with the rotary cap of the automatic pencil (not shown), the rotary member 60 is rotated, causing the helical spring 40 to force the lead holder tube 10 upwards or downwards, and therefore the lead 80 is moved in or out of the front socket member 50.

Figure 4:
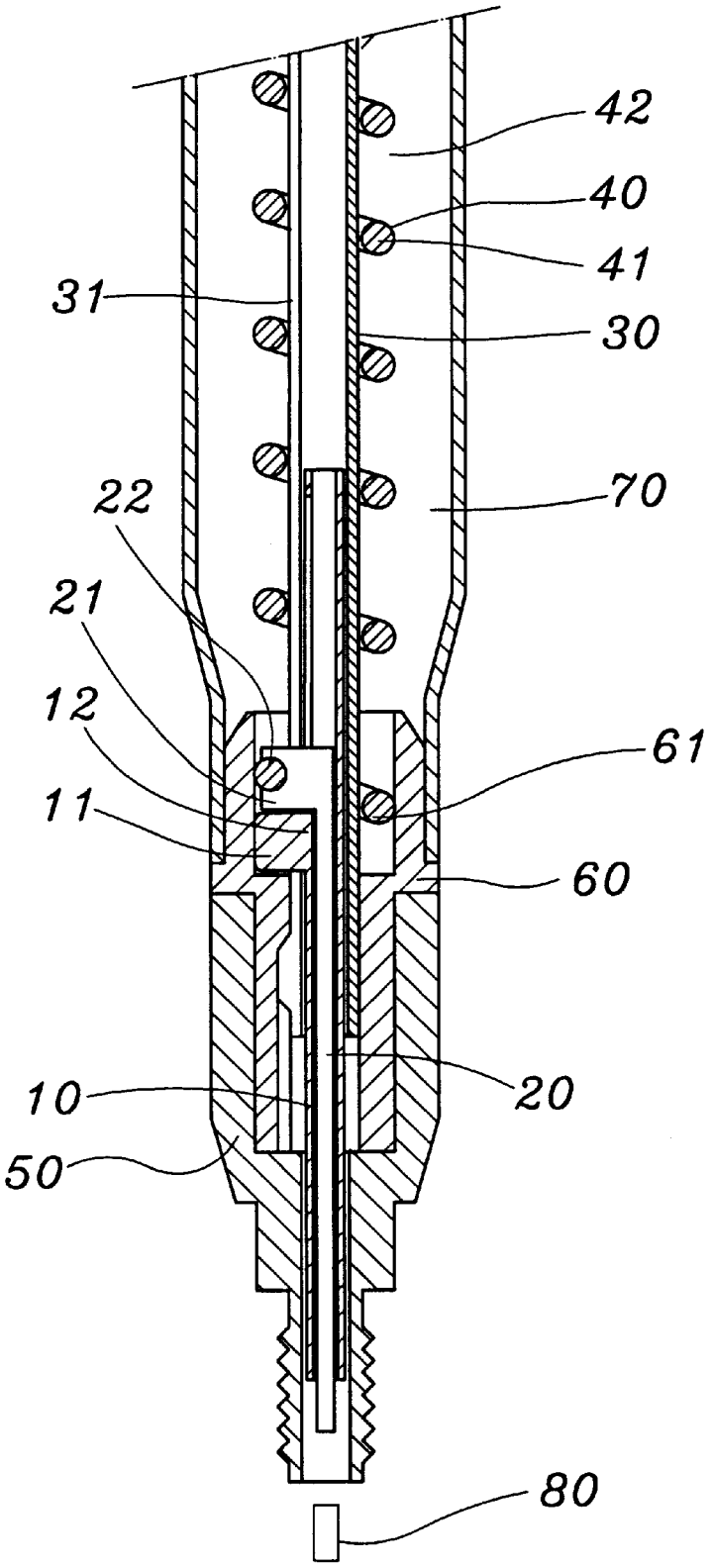
FIG. 4 shows the lead holder tube moved to the lower limit position, the propelling element lowered.

Referring to FIG. 4, when the lead holder tube 10 is lowered to the lower limit position and the sleeve 70 is continuously rotated, the propelling element 20 is forced downwards by the helical spring 40 to push the lead 80 forwards. enabling the lead 80 to be fully utilized.

Figure 5:
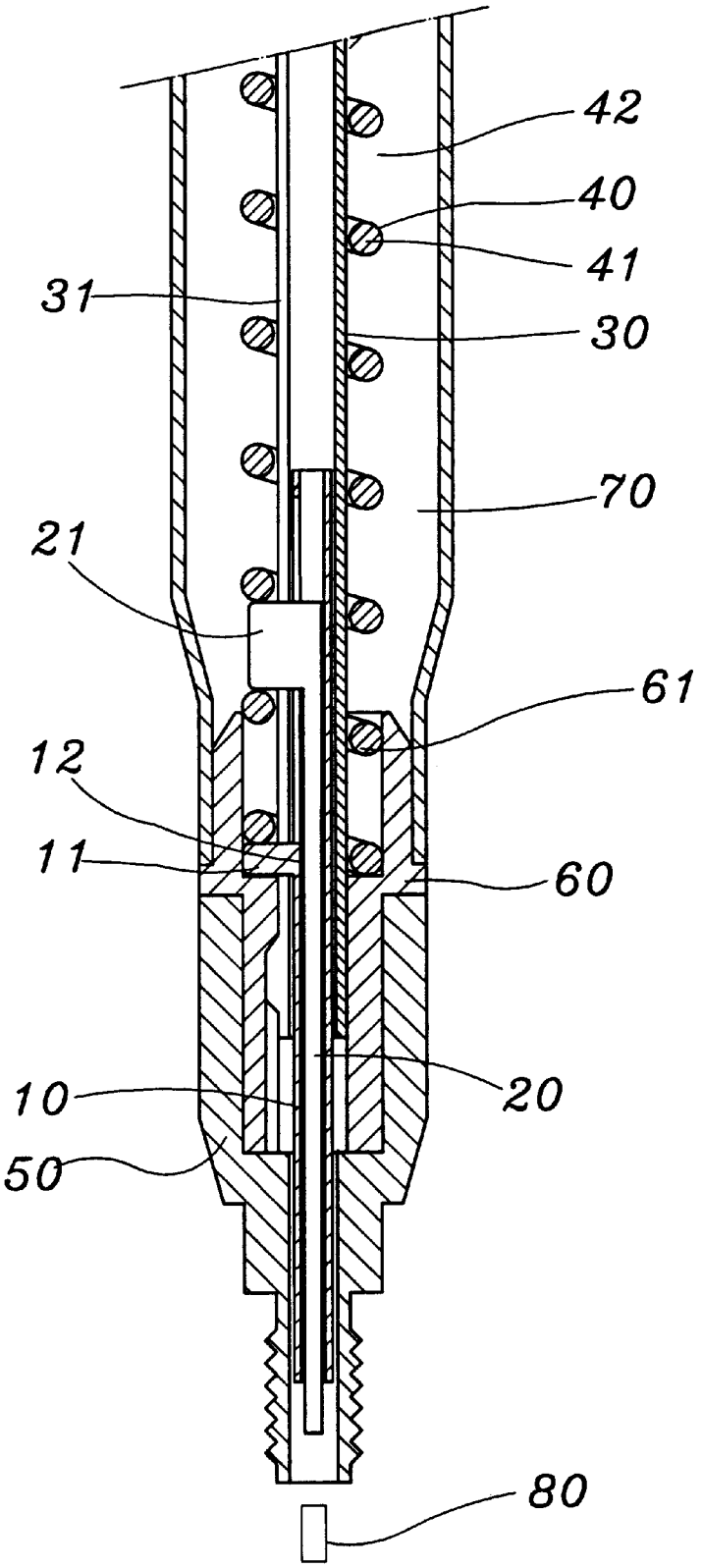
FIG. 5 is a sectional view of an alternate form of the present invention, showing the projecting rod of the propelling element engaged into the spiral way in the helical spring.

Referring to FIG. 5, the projecting rod 21 of the propelling element 20 can be engaged into the spiral way 42 and rotated upwards or downwards along the spiral way 42.

Figure 6:
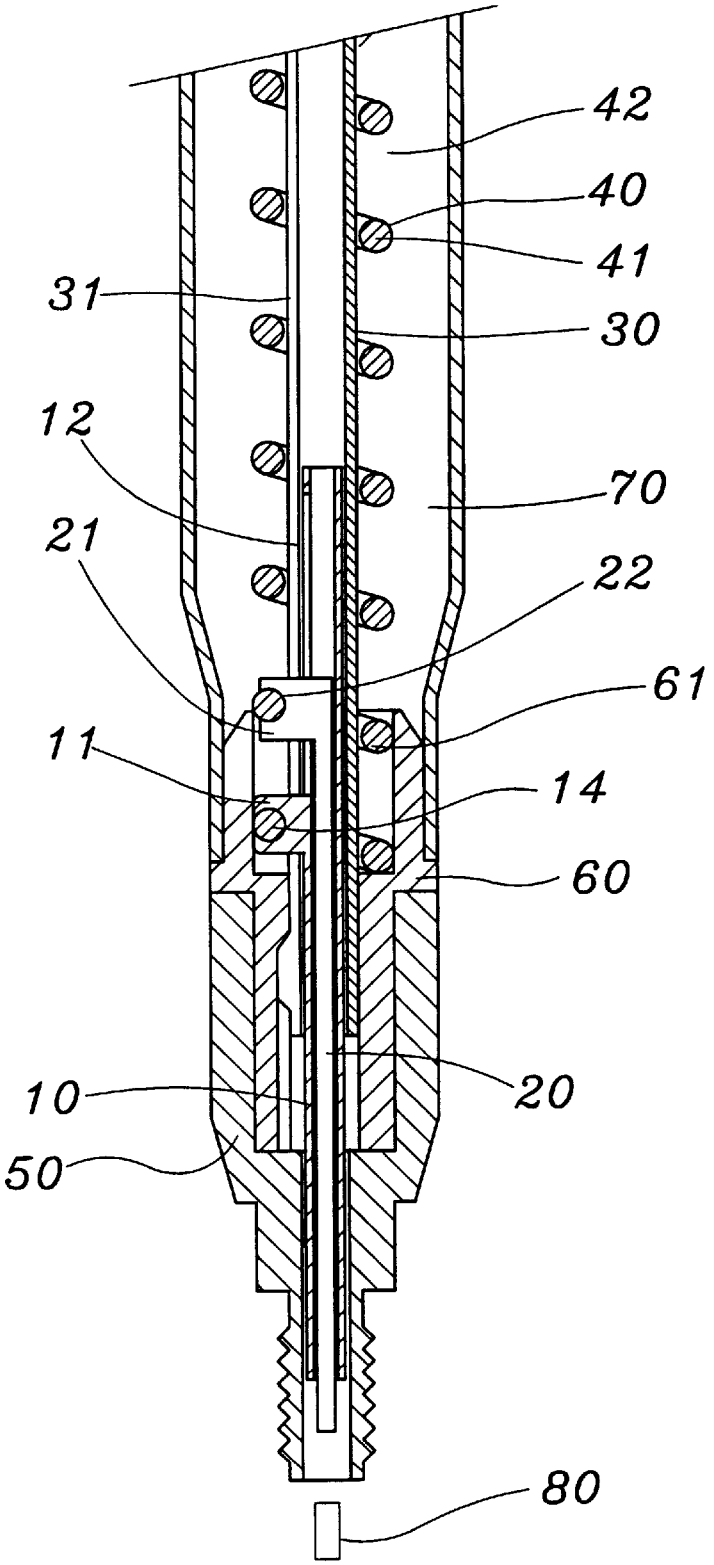
FIG. 6 is a sectional view of another alternate form of the present invention, showing the wire body of the helical spring coupled to a U-notch at the projecting rod of the head holder tube.

Referring to FIG. 6, the projecting rod 11 of the lead holder tube 10 can be made having a through hole (or U-notch) for coupling to the wire body 41 of the helical spring 40.

Referring to FIGS. 1 and 1B again, the lead holder tube 10 has an annular dent 13 disposed around the periphery and spaced from the bottom end thereof at a distance. The inner diameter of the lead holder tube 10 at the annular dent 13 is relatively smaller for holding a smaller diameter of lead. The inner diameter of the bottom end of the lead holder tube 10 is relatively greater than that at the annular dent 13 for holding a relatively bigger diameter of lead.

Figure 7:
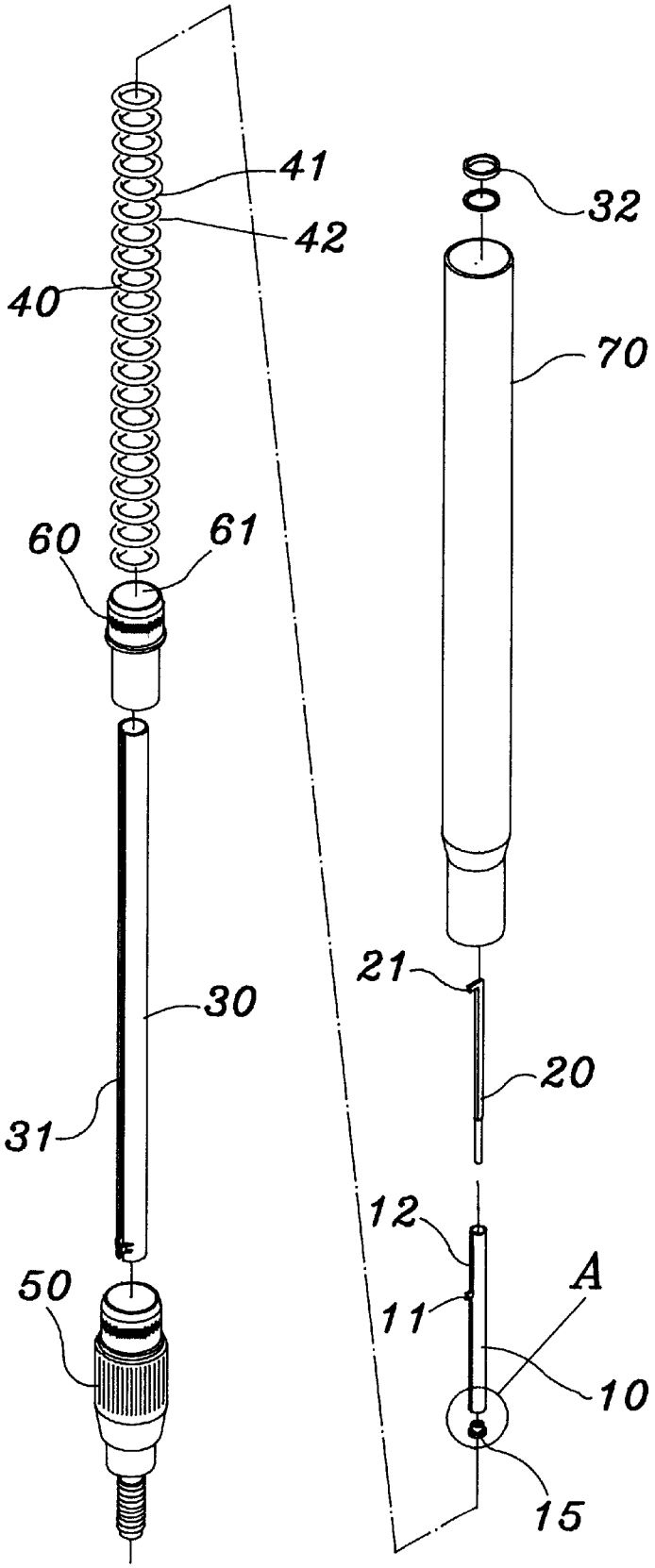
FIG. 7 is an exploded view of still another alternate form of the present invention, showing a lead adapter provided.
Figure 7A:
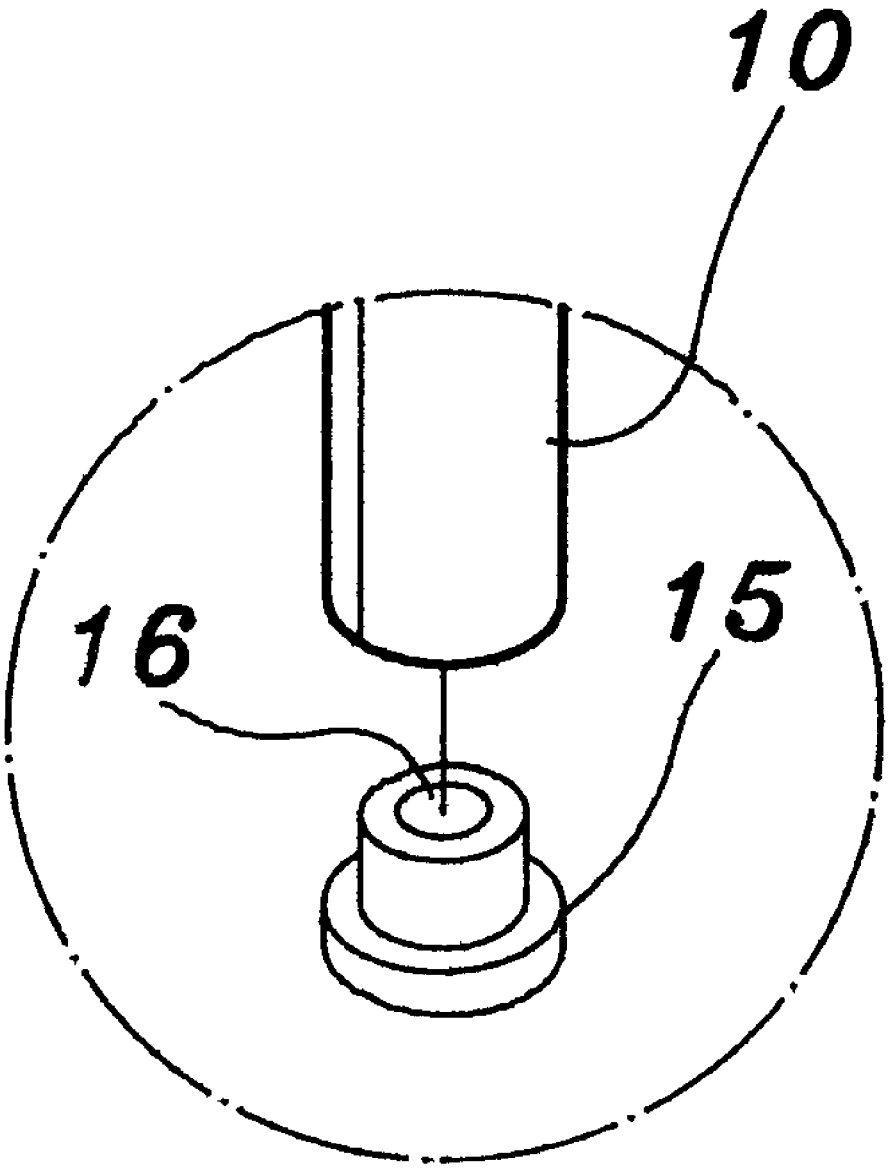
FIG. 7A is an enlarged view of part A of FIG. 7.

Referring to FIGS. 7 and 7A, an adapter 15 may be attached to the bottom end of the lead holder tube 10 to hold a lead in the axial hole 16 thereof. Therefore, a different adapter 15 can be attached to the lead holder tube 10 to hold a different size of lead.

It is to be understood that the drawings are designed for purposes of illustration only, and are not intended as a definition of the limits and scope of the invention disclosed.

What the invention claimed is:

1. A rotary type automatic pencil comprising:

a front socket member;

a guide tube having a longitudinal sliding slot and a bottom extending into said front socket member;

a rotary member mounted within said front socket member and rotated around said guide tube;

a helical spring mounted around said guide tube and fastened to said rotary member;

a lead holder tube having a first diameter for holding leads of a similar diameter mounted inside said guide tube and moved along the longitudinal sliding slot of said guide tube and holding a lead for writing, said lead holder tube having a longitudinal sliding slot at the periphery and a projecting rod raised from the periphery, the projecting rod of said lead holder tube being inserted through the longitudinal sliding slot of said guide tube and coupled to said helical spring;

a propelling element inserted into said lead holder tube at a top side and stopped against the lead held in said lead holder tube, said propelling element having a projecting rod perpendicularly raised from a top end thereof and inserted through the longitudinal sliding slot of said lead holder tube and the longitudinal sliding slot of said guide tube and coupled to said helical spring; and a lead adapter having a second diameter and being fittable into said lead holder for holding leads having a diameter similar to said second diameter wherein rotating said rotary member causes said helical spring to force said lead holder tube and said propelling element downwards/upwards along the longitudinal sliding slot of said guide tube; said propelling element is continuously lowered to push the lead out of said lead holder tube when said lead holder tube is stopped in a lower limit position at a bottom end of the longitudinal sliding slot of said guide tube and said rotary member is continuously rotated.

2. The rotary type automatic pencil of claim 1 further comprising a sleeve mounted around said helical spring and said guide tube and fastened to said rotary member for turning by hand to rotate said rotary member in said front socket member.

3. The rotary type automatic pencil of claim 1 wherein the projecting rod of said lead holder tube has a U-notch coupled to of said helical spring.

4. The rotary type automatic pencil of claim 1 wherein said lead holder tube has a stepped inside wall defining different diameters at different elevations with the largest diameter disposed at an outer side and the smallest diameter disposed at an inner side.

* * * * *